US005690156A

United States Patent [19]

Ruggles

[11] Patent Number: 5,690,156

[45] Date of Patent: Nov. 25, 1997

[54] HORIZONTAL WINDOW SHADE

[75] Inventor: Bryan K. Ruggles, Salt Lake City, Utah

[73] Assignee: Newell Operating Company, Freeport, Ill.

[21] Appl. No.: 602,590

[22] Filed: Feb. 16, 1996

Related U.S. Application Data

[63] Continuation-in-part of Ser. No. 263,058, Jun. 21, 1994, abandoned.

[51] Int. Cl.[6] ..... E06B 9/06

[52] U.S. Cl. ..... 160/84.04

[58] Field of Search ..... 160/84.01, 84.02, 160/84.03, 84.04, 84.05, 84.06, 84.07, 264, 348

[56] References Cited

U.S. PATENT DOCUMENTS

| | | | |
|---|---|---|---|
| 1,937,342 | 11/1933 | Higbie . | |
| 2,267,869 | 12/1941 | Loehr . | |
| 2,770,298 | 11/1956 | Hiatt . | |
| 2,914,122 | 11/1959 | Pinto . | |
| 2,994,370 | 8/1961 | Pinto . | |
| 3,092,870 | 6/1963 | Baer . | |
| 3,302,690 | 2/1967 | Hurd . | |
| 3,411,561 | 11/1968 | Mock . | |
| 3,422,878 | 1/1969 | Galietti . | |
| 3,844,330 | 10/1974 | Hyman . | |
| 3,851,699 | 12/1974 | Shapiro . | |
| 3,946,789 | 3/1976 | Ronkholz-Tölle, nee Tölle . | |
| 4,114,233 | 9/1978 | Hamilton . | |
| 4,438,605 | 3/1984 | DeLucia . | |
| 4,741,375 | 5/1988 | Milford et al. | 160/84.06 |
| 4,846,243 | 7/1989 | Schneider . | |
| 4,934,435 | 6/1990 | Regev | 160/84.04 |
| 5,012,552 | 5/1991 | Wulf . | |
| 5,090,098 | 2/1992 | Seveik et al. . | |
| 5,097,884 | 3/1992 | Sevcik et al. . | |
| 5,099,904 | 3/1992 | Susnar . | |
| 5,102,598 | 4/1992 | Chen . | |
| 5,105,870 | 4/1992 | Merjane . | |
| 5,129,440 | 7/1992 | Colson . | |
| 5,143,136 | 9/1992 | John . | |
| 5,158,632 | 10/1992 | Colson et al. . | |
| 5,273,096 | 12/1993 | Thomsen et al. | 160/84.01 |
| 5,287,908 | 2/1994 | Hoffmann et al. . | |
| 5,313,998 | 5/1994 | Colson et al. . | |
| 5,339,883 | 8/1994 | Colson et al. . | |
| 5,392,833 | 2/1995 | Ohanesian . | |
| 5,419,385 | 5/1995 | Vogel et al. . | |
| 5,425,408 | 6/1995 | Colson . | |
| 5,490,553 | 2/1996 | Colson et al. . | |
| 5,566,735 | 10/1996 | Jelic | 160/84.04 |

FOREIGN PATENT DOCUMENTS

| | | |
|---|---|---|
| 0653539 | 5/1995 | European Pat. Off. . |
| 0654577 | 5/1995 | European Pat. Off. . |
| WO9425719 | 11/1994 | WIPO . |

*Primary Examiner*—David M. Purol
*Attorney, Agent, or Firm*—Foley & Lardner

[57] ABSTRACT

A Roman shade type window covering is disclosed including a plurality of horizontally aligned cylindrical sleeves attached to suspension strings. A plurality of fabric strips are supported by the cylindrical sleeves, preferably by semi-cylindral beads on the upper and lower edges of the fabric. Each strip is supported by a pair of sleeves or a sleeve and either the headrail or bottom rail.

20 Claims, 4 Drawing Sheets

FIG. 1
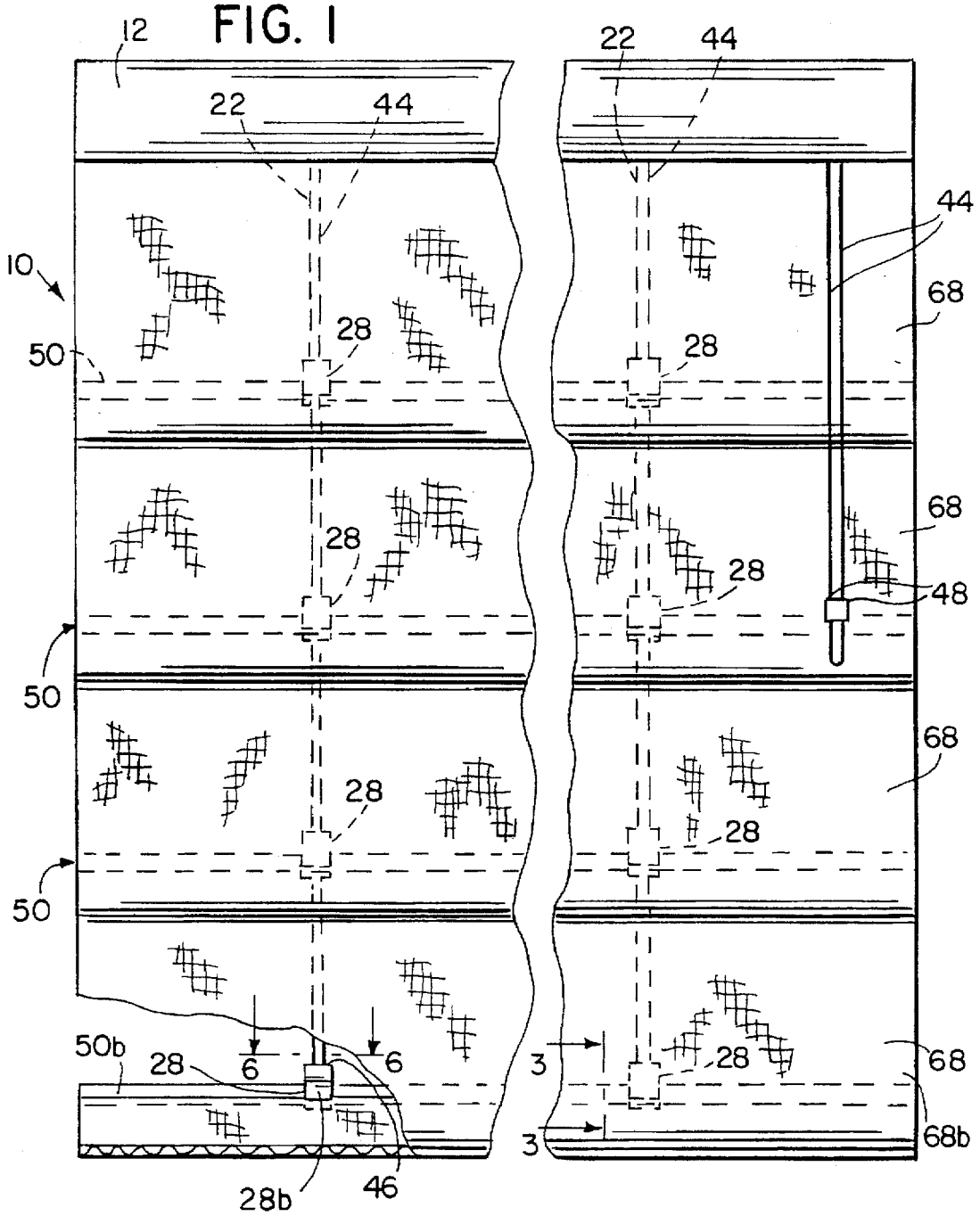
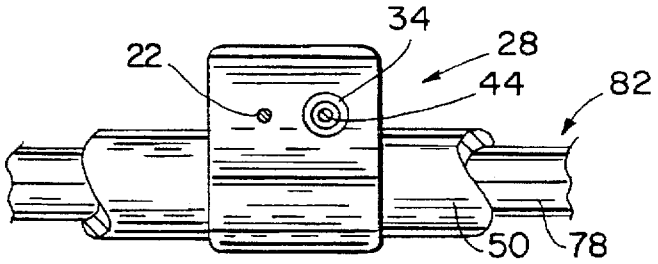
FIG. 6

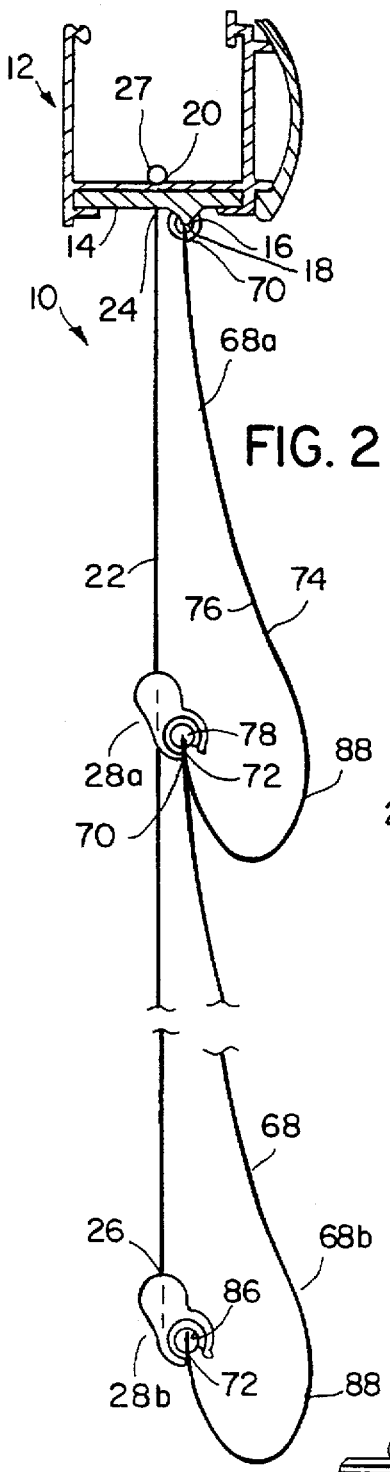
FIG. 2
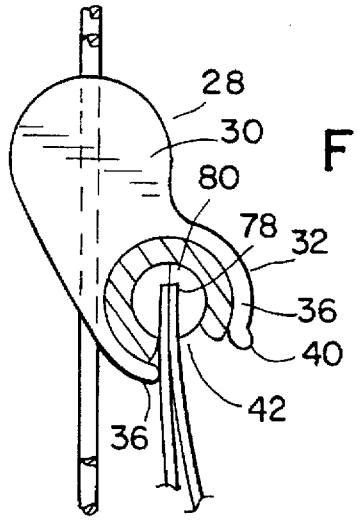
FIG. 3
FIG. 4
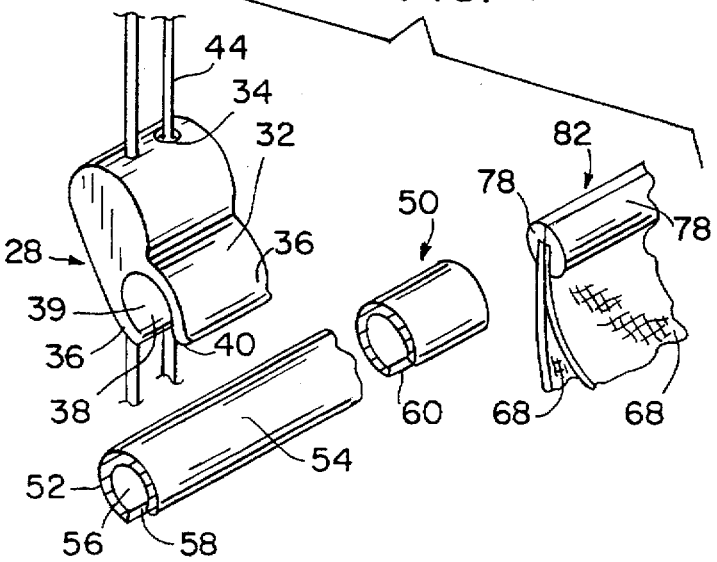
FIG. 5
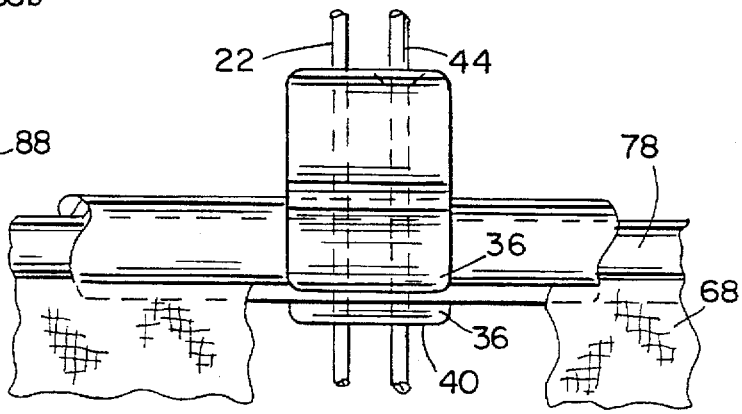

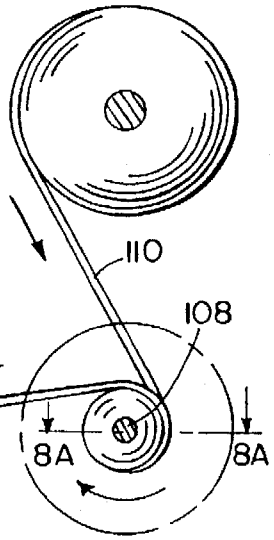
FIG. 8A
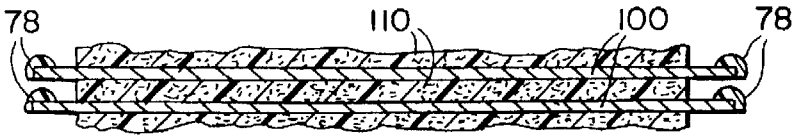
FIG. 8
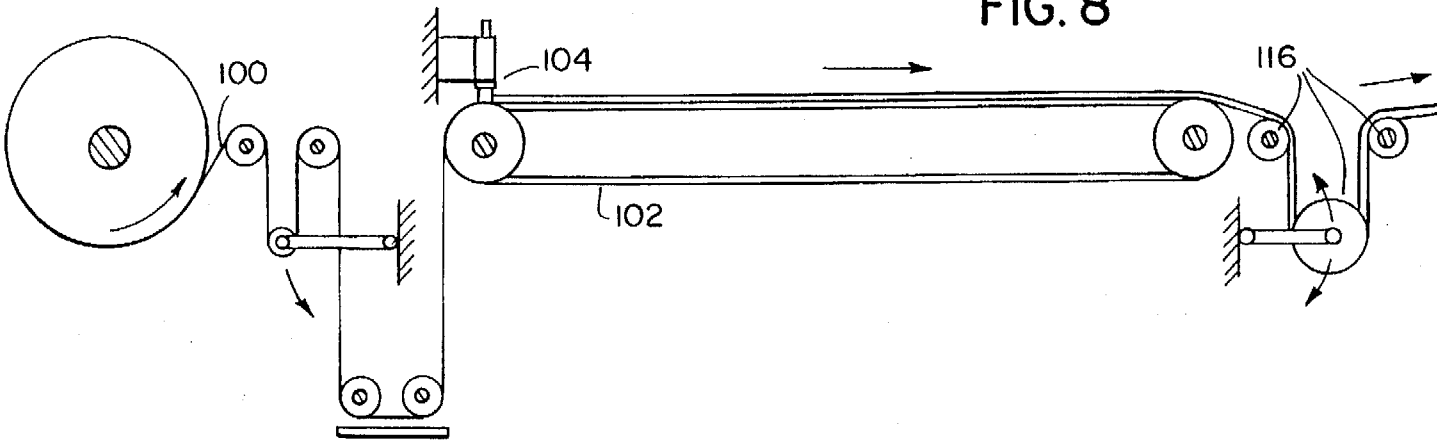
FIG. 9
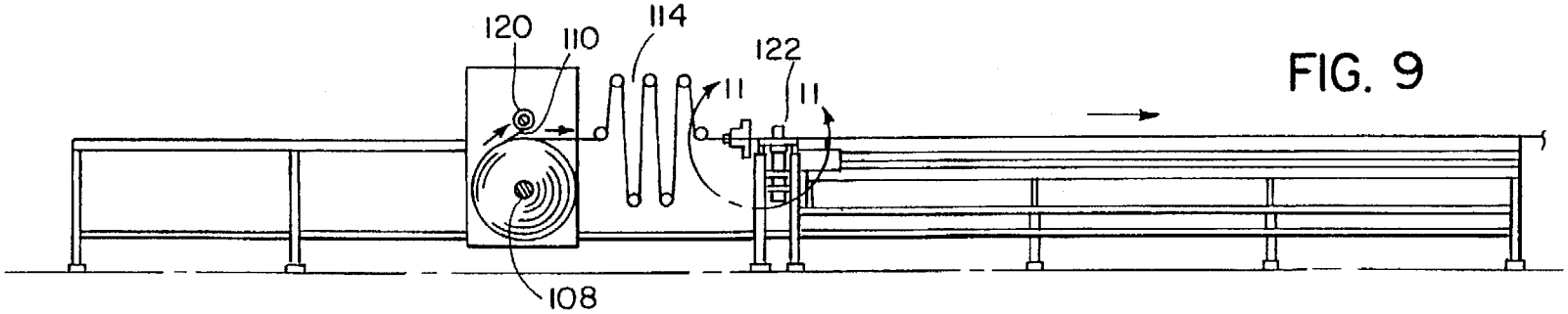

HORIZONTAL WINDOW SHADE

CROSS REFERENCE TO RELATED APPLICATIONS

This is a continuation-in-part of U.S. application Ser. No. 08/263,058 filed Jun. 21, 1994 now abandoned.

BACKGROUND OF THE INVENTION

This invention relates to a horizontal window shade. More particularly, this invention relates to a window covering of the Roman shade type having a plurality of soft, flexible fabric strips arranged such that each strip has a curvilinear shape. Roman shade window coverings are preferred by many consumers for their smooth, uncreased and soft, billowing appearance.

To be competitive, manufacturers must produce Roman shades in high volumes and in an economical manner. Additionally, Roman shades must be designed for appearance, as well as for manufacture and assembly.

Traditionally, the fabric strips of a Roman shade were sewn to one another by hand, which method was both inefficient and expensive. Another method employed was to utilize one continuous piece of fabric sewn with soft billowing pleats. However, in this method, the width of the overall window shade is limited to the size of the continuous piece of fabric. Attempts have been made to minimize the time and expense for manufacturing and assembling the fabric strips of a Roman shade window covering.

For example, U.S. Pat. No. 5,158,632, issued Oct. 27, 1992 to Colson, et al. for a "Method Of Making An Expandable And Collapsible Window Covering", discloses a Roman shade type window covering in which an unpleated facing fabric is adhesively bonded to a rear pleated panel transversely across the width of the panel at uniformly spaced intervals.

The Roman shade created by the above-described method results in a tubular type of window covering in which the facing fabric is supported by and attached to the rear pleated panel extending the full length and width of the window covering. The use of the rear panel as a support results in consumption of a significant amount of material.

Accordingly, it would be desirable to have a Roman shade window covering that would not require a support to span the full length and width of the shade.

SUMMARY OF THE INVENTION

The present invention features a novel horizontal shade. The shade includes at least two suspension strings attached to a headrail and a plurality of clips attached to each of the suspension strings. The shade further includes a plurality of sleeves, having a an internal longitudinal cavity. Each sleeve is horizontally supported by at least two clips. The shade also includes a plurality of parallel horizontal fabric strips, each strip having a top edge and a bottom edge. The bottom edge of one strip and the top edge of an adjacent strip are supported within the longitudinal cavity.

In accordance with another aspect of the invention the fabric strip includes a portion intermediate the top edge and bottom edge. The portion extends outwardly and downwardly from the sleeve that supports the strip.

In another aspect of the invention, a Roman shade includes a longitudinal headrail and at least a pair of suspension strings attached to the headrail. The Roman shade further includes a plurality of sleeves, each sleeve having an internal longitudinal cavity. Each sleeve is attached to the suspension strings. The Roman shade further includes a curtain having a plurality of cylindrical protuberances attached thereto. The cylindrical protuberances are slidably received within the longitudinal cavity of the sleeves.

In accordance with yet another aspect of the invention, a Roman shade includes a longitudinal headrail and at least a pair of suspension strings attached to the headrail. The Roman shade also includes a plurality of fasteners attached to the suspension strings, and a plurality of sleeves. Each sleeve has an internal longitudinal cavity and is supported by the fasteners. The Roman shade further includes a plurality of parallel horizontal fabric strips. Each strip has a top edge and a bottom edge. The top and bottom edges each have a longitudinal bead attached thereto. The bottom edge of one strip and the top edge of an adjacent strip are supported within the longitudinal cavity. Each fabric strip includes a portion intermediate the top edge and bottom edge. The portion extends outwardly and downwardly from the sleeve that supports the strip.

BRIEF DESCRIPTION OF THE DRAWINGS

The invention will hereafter be described with reference to the accompanying drawings, wherein like reference numerals denote like elements, and:

FIG. 1 is a front view of the window shade showing parts broken away and showing certain features in phantom;

FIG. 2 is an end view of the window shade;

FIG. 3 is a side view of the clip, sleeve, and fabric strips;

FIG. 4 is an isometric exploded view of the clip, sleeve, and fabric strips of FIG. 3;

FIG. 5 is a front view of the clip and sleeve with parts broken away and showing certain components in phantom;

FIG. 6 is a top view of the clip and sleeve;

FIG. 8 is a schematic view of the bead application system;

FIG. 8A is a schematic cross-sectional view of the fabric web and foam interleaf;

FIG. 9 is a schematic view of the fabric and louver assembly system;

DETAILED DESCRIPTION OF THE PREFERRED EMBODIMENT

Figure 7:
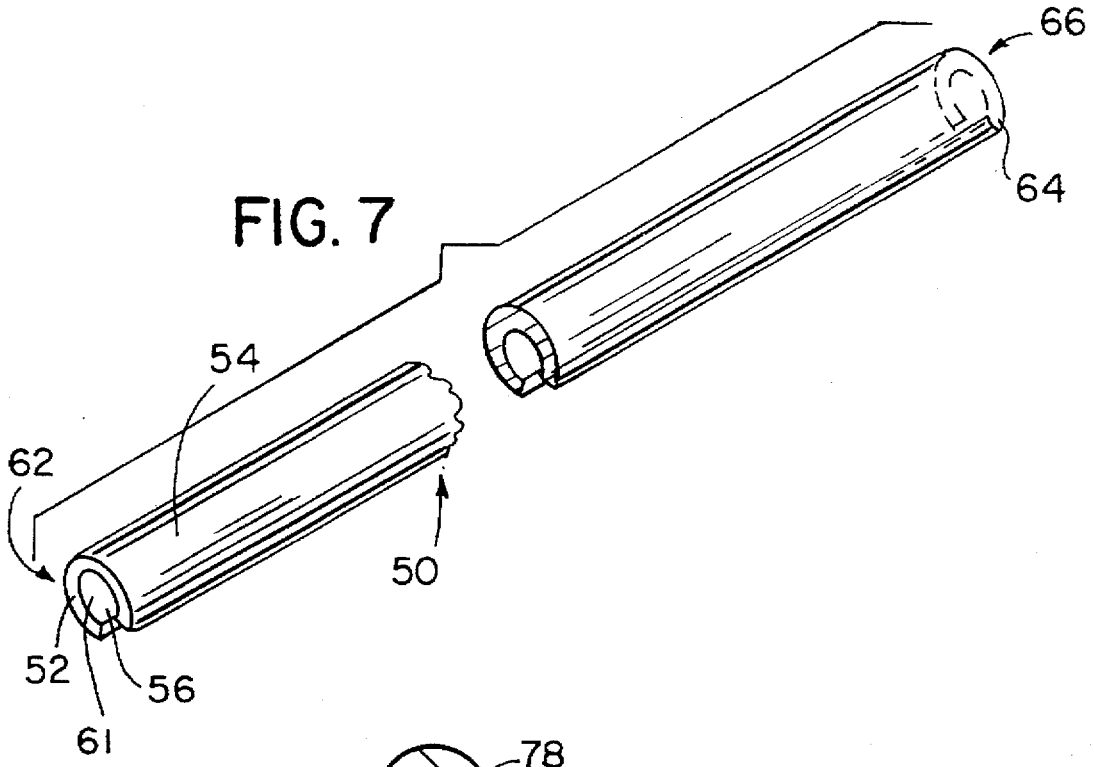
FIG. 7 is an isometric view of a sleeve.

Referring generally to FIGS. 1–6, a detailed description of an exemplary window covering 10 will be described. Window covering 10 includes an elongated headrail 12 having a bottom panel 14 provided with an integrally formed semi-cylindrical channel 16 extending substantially the length of headrail 12. Channel 16 includes a channel opening 18 defining a passageway from the exterior of bottom panel 14 to semi-cylindrical channel 16. Bottom panel 14 further includes a pair of apertures 20 extending therethrough.

Window covering 10 also includes a pair of spaced apart suspension strings 22. Three or more strings 22 could be used as is well known, e.g., in the horizontal mini-blind industry, for use with wider or heavier window coverings, Each suspension string 22 includes a top end 24 and a bottom end 26. Top end 24 of suspension string 22 extends through aperture 20 and is attached to and suspended from headrail 12. Suspension string 22 may include a spherical member 27 attached to top end 24 having a diameter larger than aperture 20 in bottom panel 14.

A plurality of vertically spaced fasteners or clips 28 are attached to each suspension string 22. A bottom clip **28*b* is attached proximate each bottom end 26. Clips 28 are arranged along each suspension string 22 such that clips 28 on one suspension string 22 are horizontally aligned with clips 28 on the other suspension string 22**.

Each clip 28 includes a main portion 30 and a clip portion 32. In the preferred embodiment, main portion 30 is molded directly onto suspension string 22 such that suspension string 22 extends through main portion 30 of clip 28. However, suspension string 22 may be attached in other ways. For example, suspension string 22 may be tied to clip 28. Main portion 30 further includes an aperture of a through hole 34 running parallel to suspension string 22. Clip portion 32 includes two resilient prongs 36 extending from main portion 30 thereby forming a cylindrical clip cavity 38 having a pair of openings 39 at either end of cavity 38. Each prong 36 includes a prong end 40. Prong ends 40 are offset from one another thereby forming a passage way 42 to cylindrical cavity 38. Clips 28 are molded onto suspension string 22 such that clip portions 32 are similarly aligned and extending in an outward direction from headrail 12. (See FIGS. 3 and 4).

Illustrated window covering 10 also includes a pair of retraction strings 44, each having a first end 46 and a second end 48. The number of retraction strings 44 will typically equal the number of suspension strings 22. First end 46 of each retraction string 44 is securably attached to bottom clip **28*b*. Each retraction string 44 loosely and retractably extends via clip through holes 34. In the preferred embodiment each retraction string 44 extends through aperture 20 in bottom panel 14 of headrail 12. Retraction string 44 extends the length of headrail 12 extending through a cordlock (not shown such that second ends 48 are available for manipulation of window covering 10 (see FIG. 1**).

Window covering 10 further includes a plurality of longitudinal sleeves 50. Each sleeve 50 extends substantially the entire length of headrail 12. Each sleeve 50 has a tubular form including a wall 52 having an exterior surface 54 and an interior surface 56 defining an internal cylindrical cavity 58. Each sleeve 50 further includes a slot 60 extending the entire length of sleeve 50 defining a passageway to internal cavity 58. Referring to FIG. 7, sleeve 50 also includes a first cavity opening 61 located at a first end 62 of sleeve 50 and normal to cylindrical cavity 58. Additionally, sleeve 50 includes a second cavity opening 64 located at a second end 66 of sleeve 50 parallel to and distal to first end 62. Wall portions 52 defining slot 60 are resilient such that when the wall portions 52 are forced apart they spring back to their original orientation.

In the preferred embodiment sleeve 50 is made from extruded aluminium. However, sleeve 50 may be alternatively formed from a variety of resilient materials including, for example, other metals or plastic. Additionally, in another embodiment sleeve 50 may be formed from a rigid material such that walls 52 may not be substantially forced apart.

Each sleeve 50 is releasably secured by at least a pair of clips 28 such that sleeves 50 are orientated horizontally and substantially parallel to headrail 12. Further, each slot 60 is orientated outward from suspension strings 22 and in a downward direction. Exterior surface 54 of sleeve 50 is received within cylindrical clip cavity 38 of clip portion 32 (see FIGS. 3 and 4). Sleeve 50 is attached to clip 28 by forcing prongs 36 away from one another to permit passage of sleeve 50 into clip cavity 38. Alternatively, sleeve 50 may be threaded or slid through clip cavity 38 through clip cavity openings 39.

Figure 11:
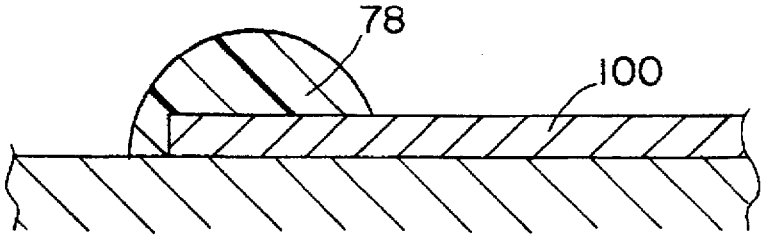
FIG. 11 is a detail of the semi-cylindrical bead forming on the fabric.

Window covering 10 further includes a curtain 67 having a plurality of parallel and horizontally aligned fabric strips 68. Each strip includes a top edge 70, a bottom edge 72, a front surface 74, and a rear surface 76. A semi-cylindrical bead 78 extending the entire length of fabric strip 68 is attached to or laid upon rear surface 76 adjacent top edge 70 and bottom edge 72. In the preferred embodiment bead 78 is extruded onto rear surface 76 of fabric strip 68 such that bead 78 extends beyond top and bottom edges 70, 72 capturing and covering all loose fibers and yarns. This prevents fraying which can occur over time. (See FIG. 11). However, bead 78 may have other configurations as well.

Semi-cylindrical beads 78 formed on fabric strips 68, may be made of an extruded thermo-plastic resin applied to or adhered to the fabric. The application of beads 78 on fabric strips 68 is described below. Beads 78 may also be made of an applied hot melt adhesive such as polyurethane or other syntectic polymer which provides the bead characteristics desired.

A first fabric strip **68*a* is attached to headrail 12 at bottom panel 14. Semi-cylindrical channel 16 in bottom panel 14 receives and supports bead 78 attached to top edge 70 of first fabric strip 68*a***.

As illustrated in FIG. 2, the distance along the first fabric strip **68*a* between top edge 70 and bottom edge 72 is greater than the distance between the bottom panel 14 of headrail 12 and the first clip 28*a*. Bottom edge 72 of the first fabric strip 68*a* is curved up toward clip 28*a*. In this manner the front surface 74 proximate bottom edge 72 faces in a rearward direction. In this orientation bottom edge 72 of the first strip is aligned with top edge 70 of an adjacent strip such that the semi-cylindrical beads 78 form a cylindrical bead member or protuberance 82 (see FIG. 4). Cylindrical bead member 82 is supported and held within internal cavity 58 of sleeve 50. Once disposed against each other, the two semi-cylindrical beads 78 forming the cylindrical bead member 82 may be forced or threaded into sleeve cavity 58. This may be accomplished by inserting the cylindrical member 82 through opening 61 or 64 at the sides 62, 64 respectively of sleeve 50. Cylindrical bead member 82** may also be threaded vertically on an assembly fixture.

Additionally, threading may be accomplished by spreading walls 52 of sleeve 50 apart and inserting cylindrical member 82 through slot 60. Walls 52 then springs back and collapses to its original position around the cylindrical member 82. This method of threading may be progressively performed along the length of sleeve 50.

To effectuate and simplify the second method of threading the cylindrical member, the walls 52 of sleeve 50 adjacent slot 60 may be turned outwardly. Specifically, sleeve 50 may include two projections adjacent each side of slot 60. The projections may include rounded surfaces to assist in the threading operation. This structure relieves some of the stresses placed on fabric strips 68.

In a similar manner, additional abutting semi-cylindrical beads 78 on adjacent bottom and top edges 70, 72 respectively form cylindrical bead members 82 and are supported by additional sleeves 50. In this way a plurality of fabric strips 68 are attached to the plurality sleeve 50.

In the preferred embodiment, cylindrical bead member 82 formed of two semi-cylindrical beads 78 is sized slightly smaller than the cylindrical cavity 58 of sleeve 50.

Finally, semi-cylindrical bead 78 on bottom edge 72 of the last fabric strip **68*b* is supported by a bottom sleeve 50*b* having a semi-cylindrical internal cavity 86**.

As noted above the distance between top edge 70 and bottom edge 72 along fabric sheet 68 is greater than the distance between adjacent clips along suspension string 22. This results in a portion 88 of each fabric strip 68 extending in an outwardly and downwardly direction and overlapping an adjacent fabric strip located distal from the headrail. Alternatively, fabric strip 68 may be formed from a material that maintains a curvilinear form such that fabric strip 68 does not extend in a downwardly direction thereby overlapping an adjacent fabric strip 68. Additionally, bead 78 may be attached to the front surface 74 of fabric strip 68 adjacent bottom edge 72, and on the rear surface 76 adjacent top edge 70.

Referring to FIG. 8 the preferred process of applying beads 78 will now be described. A roll of fabric web 100 from which fabric strips 68 will be formed is first slit to the preferred width W (not shown).

Figure 10:
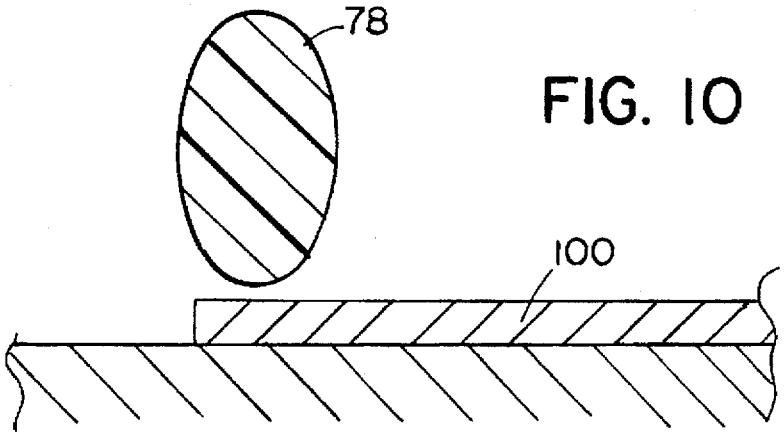
FIG. 10 is a schematic of the extruded bead as it leaves the nozzle.

Fabric web 100 once slit to the appropriate width is fed onto a conveyor belt 102 having a non stick surface. Fabric web 100 is guided under a pair of glue nozzles 104 as it is pulled along belt 102. Nozzles 104 are positioned over the fabric edges and a hot polyurethane reactive glue is extruded through nozzles 104 onto a rear side of moving fabric web 100. In the preferred embodiment the temperature of the extruded glue is about 120 degrees C. Beads 78 are extruded in a semi-elliptical shape with the tall axis of the ellipse oriented vertically. (see FIG. 10). As the glue is cooling, its viscosity is tailored to allow it to flatten out into a semi-circular shape with a portion of bead 78 extending off the fabric edge onto non-stick belt 102. (See FIG. 11). This allows beads 78 to totally bind the edges of fabric web 100. Beads 78 have a bead radius R.

In the preferred embodiment belt 102 has a length of 40 feet and travels at a speed in the range of 20–50 feet per minute. This allows time for beads 78 to harden to a tack-free state at the end of belt 102. Fabric web 100 with beads 78 is "peeled off" at the end of belt 102. Fabric web 100 then travels through a series of rollers 106 to a rewind spool 108 having a six inch diameter core. However, the diameter of the core may vary.

A foam interleaf 110 fed from roller 112 is interwound with fabric web 100 between beads 78. Foam interleaf 110 acts as a bridge for the portion of fabric web 100 intermediate beads 78. Foam 110 prevents fabric web 100 from being wound unevenly on spool 108. In the preferred embodiment, foam 110 is at least as thick as bead radius R (see FIG. 8A) when under slight compression.

When a desired length of fabric web 100 is wound, rewind spool 108 is doffed and stored until cured enough for assembly. In the preferred embodiment, fabric webs with beads 78 are cured approximately two weeks to permit the beads to harden which results in a low coefficient of friction.

Once fabric web 100 has cured, fabric strips 68 are formed. Fabric web 100 with cured beads 78 is unwound from fabric web roll 108. A take up roll 120 takes up foam 110 as a leading edge of fabric web 100 is unwound from fabric web roll 108. The fabric web is subsequently cut to predetermined lengths to form fabric strips 68 at a cutting station 122 which may include a sonic slitter. (FIG. 9).

Although the invention has been described in conjunction with specific embodiments thereof, it is evident that many alternatives, modifications and variations will be apparent to those skilled in the art. For example, a clip 28 may be attached proximate bottom panel 14 of headrail 12 in lieu of channel 16 for attachment of top edge 70 of first fabric strip **68*a*. Additionally, curtain 67 may be formed from a single fabric having a plurality of cylindrical protuberances 82 attached thereto and slidably located within cylindrical cavities 58. Further, clips 28 may be any other type of mechanical fastener that could secure sleeve 50 to suspension strings 22**.

Accordingly, it is intended to embrace all such alternatives, modifications and variations that fall within the spirit and broad scope of the invention and of the appended claims.

What is claimed is:

1. A horizontal shade including at least a pair of suspension strings attached to a headrail, the shade comprising:

a plurality of clips attached to each of the suspension strings;

a plurality of sleeves, each sleeve having an internal longitudinal cavity, wherein each sleeve is horizontally supported by at least two clips; and a plurality of parallel horizontal fabric strips, each strip having a top edge and a bottom edge, wherein the bottom edge of one strip and the top edge of an adjacent strip are supported within the longitudinal cavity;

wherein each top edge and bottom edge includes a longitudinal bead attached thereto.

2. The shade of claim 1, wherein each clip includes an aperture and a pair of resilient prongs.

3. A horizontal shade including at least a pair of suspension strings attached to a headrail, the shade comprising:

a plurality of clips attached to each of the suspension strings;

a plurality of sleeves, each sleeve having an internal longitudinal cavity, wherein each sleeve is horizontally supported by at least two clips; and a plurality of a parallel horizontal fabric strips, each strip having a top edge and a bottom edge, wherein the bottom edge of one strip and the top edge of an adjacent strip are supported within the longitudinal cavity, wherein each clip includes an aperture and a pair of resilient prongs; and at least two retraction strings, each retraction string being attached to a bottom clip and slidably extending through the aperture of each clip between the bottom clip and headrail;

wherein each top edge and bottom edge includes a longitudinal bead attached thereto.

4. The shade of claim 3, wherein the bead attached to the bottom edge of one fabric strip and the bead attached to the top edge of the adjacent fabric strip forms a cylindrical protuberance.

5. The shade of claim 4, wherein the internal longitudinal cavity of the sleeve receives the cylindrical protuberance.

6. The shade of claim 5, wherein each sleeve further includes a passageway connecting an exterior surface of the sleeve and the internal longitudinal cavity.

7. The shade of claim 6, wherein the cylindrical protuberance is frictionally held within the internal longitudinal cavity.

8. The shade of claim 6, wherein the cylindrical protuberance is mechanically engaged within the internal longitudinal cavity.

9. The shade of claim 6, wherein the distance along each fabric strip between the top edge and the bottom edge is greater than the distance between adjacent clips attached to the suspension string.

10. The shade of claim 9, wherein the fabric strip includes a portion intermediate the top edge and bottom edge which extends outward and downward from the sleeve that supports the strip.

11. A Roman shade comprising:

a longitudinal headrail;

at least a pair of suspension strings attached to the headrail;

a plurality of sleeves, each sleeve having an internal longitudinal cavity, wherein each sleeve is attached to the suspension strings; and a curtain including a plurality of cylindrical protuberances attached thereto and slidably received within the longitudinal cavity of the sleeves.

12. The Roman shade of claim 11, wherein the curtain includes a plurality of parallel horizontal fabric strips, each strip having a top edge and a bottom edge, wherein the bottom edge of one strip and the top edge of an adjacent strip are supported within the longitudinal cavity.

13. The Roman shade of claim 12 further including a plurality of clips attached to each of the suspension strings, wherein each sleeve is horizontally supported by at least two clips.

14. The Roman shade of claim 13, further including a pair of retraction strings, each retraction string attached to a bottom clip and slidably extending through the aperture of each clip between the bottom clip and headrail.

15. The Roman shade of claim 14, wherein each top edge and bottom edge includes a longitudinal bead attached thereto.

16. The shade of claim 15, wherein the bead of the bottom edge of one strip and the bead of the top edge of the adjacent strip forms the cylindrical protuberance.

17. The shade of claim 16, wherein each sleeve further includes a passageway connecting an exterior surface of the sleeve and the internal longitudinal cavity.

18. AS Roman shade comprising:

a longitudinal headrail;

at least two spaced apart suspension strings attached to the headrail;

a plurality of fasteners attached to each suspension string;

a plurality of sleeves, each sleeve having an internal longitudinal cavity, wherein each sleeve is horizontally supported by the fasteners;

a plurality of parallel horizontal fabric strips, each strip having a top edge and a bottom edge, the top and bottom edges having a longitudinal bead attached thereto, the bottom edge of one strip and the top edge of an adjacent strip being supported within the longitudinal cavity; and wherein each fabric strip includes a portion intermediate the top edge and bottom edge which extends outward and downward from the sleeve that supports the strip.

19. The Roman shade of claim 18, wherein the fastener is a pair of clips, each clip being attached to a suspension string, each clip including an aperture extending therethrough substantially parallel to the suspension string.

20. The Roman shade of claim 19, further including at least one retraction string, attached to a bottom clip and slidably extending through the aperture of each clip between the bottom clip and the headrail.

* * * * *

UNITED STATES PATENT AND TRADEMARK OFFICE

CERTIFICATE OF CORRECTION

PATENT NO. : 5,690,156

DATED : November 25, 1997

INVENTOR(S) : Bryan K. Ruggles

It is certified that error appears in the above-indentified patent and that said Letters Patent is hereby corrected as shown below:

IN THE CLAIMS

In claim 18, line 4, change "AS" to --A--.

Signed and Sealed this

Seventeenth Day of February, 1998

*Attest:*

Bruce Lehman

BRUCE LEHMAN

*Attesting Officer*

*Commissioner of Patents and Trademarks*